United States Patent [19]

Timmins et al.

[11] Patent Number: 5,004,102

[45] Date of Patent: Apr. 2, 1991

[54] RACK FOR TRANSPORTING VEHICLE CENTER CONSOLE ASSEMBLIES

[75] Inventors: Lawrence J. Timmins, Riverview; Duane K. Krause, Grosse Pointe Woods, both of Mich.

[73] Assignee: Chrysler Corporation, Highland Park, Mich.

[21] Appl No.: 559,773

[22] Filed: Jul. 30, 1990

[51] Int. Cl.[5] ..... B65D 19/00

[52] U.S. Cl. ..... 206/386; 206/319; 206/321; 206/596; 206/600

[58] Field of Search ..... 206/319, 321, 322, 386, 206/485, 453, 595, 599, 600, 586; 211/41

[56] References Cited

U.S. PATENT DOCUMENTS

| | | | |
|---|---|---|---|
| 3,137,388 | 6/1964 | Strouth | 206/321 |
| 3,777,885 | 12/1973 | Barteck | 206/319 |
| 4,303,157 | 12/1981 | Edwards | 206/485 |
| 4,403,697 | 9/1983 | Forshee | 206/600 |
| 4,413,737 | 11/1983 | Wind | 206/599 |
| 4,580,680 | 4/1986 | Wind | 206/600 |
| 4,673,087 | 6/1987 | Webb | 206/600 |
| 4,785,957 | 11/1988 | Beck et al. | 206/600 |
| 4,936,451 | 6/1990 | Shuert | 206/600 |

*Primary Examiner*—David T. Fidei
*Attorney, Agent, or Firm*—Edward A. Craig

[57] ABSTRACT

A shipping rack is provided for storing and transporting vehicle center console assemblies which must be adequately supported to prevent movement thereof during shipment which could cause damage to finished surfaces. The shipping rack includes a plurality of supports, each of which receives a vehicle center console assembly and supports the assembly without contact with other assemblies and in such fashion as to prevent longitudinal or transverse movement. Vertical movement is prevented by use of lids on the shipping rack.

5 Claims, 2 Drawing Sheets

RACK FOR TRANSPORTING VEHICLE CENTER CONSOLE ASSEMBLIES

BACKGOUND OF THE INVENTION

1. Field of the Invention

This invention relates to a rack for transporting vehicle center console assemblies. The rack is reusable. The rack includes support structure for receiving and supporting vehicle center console assemblies without making contact with finished surfaces.

2. Prior Art

In modern automotive manufacturing, it is common practice to assembly complete vehicles at a single location from various parts and components which are shipped to the assembly location from other locations. The parts and components are normally fabricated in facilities remote from the assembly location, packaged and them shipped to the assembly locations. The packaging frequently has involved the use of cardboard. This has caused a problem at the point of use. Cardboard creates a disposal problem. The disposal of such cardboard materials has engendered relatively high costs.

It is desired to use returnable racks and containers, particularly such as are constructed of plastic materials. Such units are relatively lightweight while at the same time being sturdy and durable in use.

However, a problem has been encountered in connection with the shipment of vehicle center console assemblies. These assemblies are of the type mounted between the two seats in the front of a vehicle. The consoles are fabricated of plastic materials and have exterior finished surfaces, referred to as "class A" surfaces. These surfaces may be marred if abraded or impacted during shipment. A damaged surface frequently results in the necessity to reject the console assembly or, at the least, involve expensive repair procedures.

In accordance with the present invention, a reusable rack for transporting vehicle center console assemblies is provided. Major portions of the rack are fabricated of a plastic material which has relatively high strength. Suitable plastic is, for example, a high density polyethylene copolymer. The construction of the rack is adapted to prevent scratching, gouging or like damage to center console assemblies during storage and transport. The rack of the present invention provides separation of the consoles from each other and from other structure. The rack is reusable and thus does not involve a disposal problem at assembly points. The reusable nature of the rack results in ultimate lower costs. Further, the rack is collapsible, thereby permitting a reduction in volume when the rack is returned for further use.

SUMMARY OF THE INVENTION

A shipping rack is provided which includes a base having a generally horizontal loading surface. A plurality of spaced apart supports are secured to the loading surface. Each support is adapted to receive and support a vehicle center console assembly. The vehicle center console assembly includes an elongated body having a longitudinal axis. An enlarged portion is provided at one end of the elongated body having a recess therein. The recess is partially defined by a pair of spaced apart side walls each of which terminates in an outer edge which is at an acute angle with respect to the longitudinal axis of the elongated body.

Each support comprises a block-like member having an exterior configuration matching the interior configuration of the recess of the enlarged portion of the vehicle center console assembly to receive a vehicle console assembly thereon with the outer edges of said side walls resting on the shipping rack loading surface and the longitudinal axis of the elongated body at an acute angle with respect to the loading surface.

The supports are arranged in at least one row on the shipping rack loading surface. Each support is spaced apart longitudinally on the shipping rack loading surface with respect to adjacent supports and is spaced apart slightly laterally on the shipping rack loading surface with respect to adjacent supports. Each support has a vertical notch in one corner. The notches of adjacent supports are provided in alternating corners to receive alternating corners of the side walls of a vehicle center console assembly mounted on adjacent supports and laterally secure the vehicle center consoles in place and prevent contact therebetween.

The exterior configuration of each support comprises a forward surface extending upwardly and rearwardly of the support at an acute angle with respect to the loading surface of the shipping rack base, a rearward surface extending upwardly at substantially right angles to the loading surface, and an upper surface interconnecting the forward and rearward surfaces. Preferably, the upper surface includes a first portion extending upwardly and forwardly from the rearward surface towards the forward surface of the support. Preferably, said upper surface further includes a laterally extending second portion comprising a V-shaped notch extending along the forward edge of the first portion of the upper surface and a third substantially horizontal portion interconnecting the second portion and the forward surface.

DETAILED DESCRIPTION OF A PREFERRED EMBODIMENT

Figure 1:
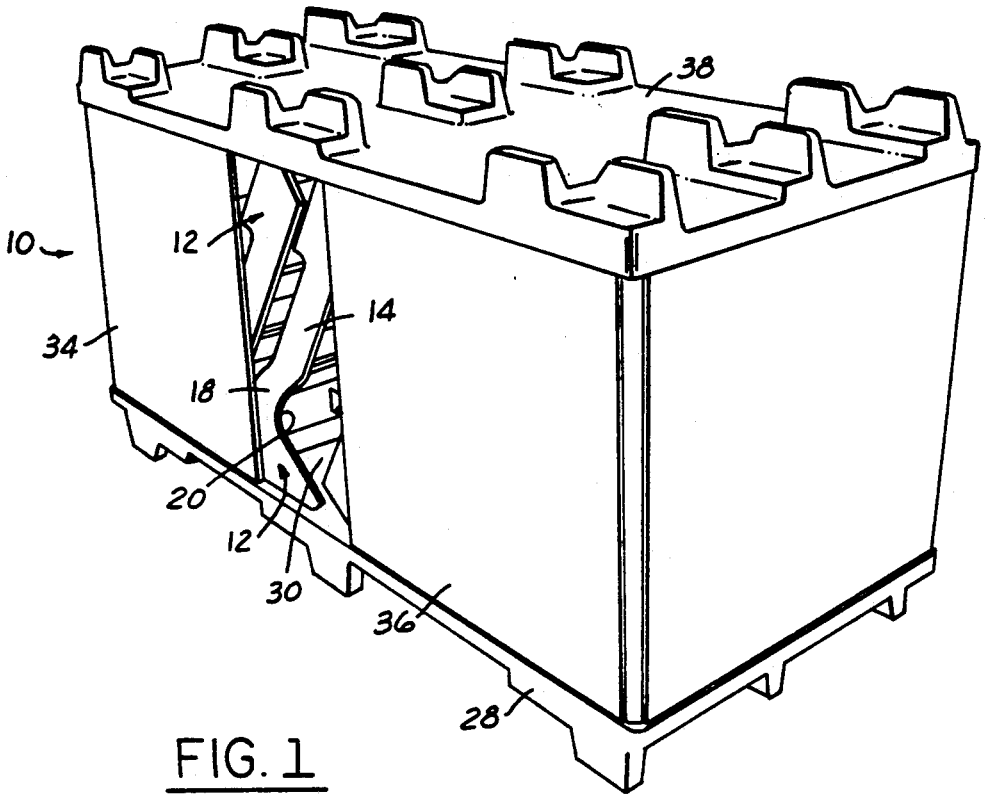
FIG. 1 is a view in perspective of one embodiment of the shipping rack of the present invention illustrated in the fully loaded condition.

Referring to the drawings, it will be noted that the shipping rack 10 is designed to receive and support a plurality of vehicle center console assemblies 12. The consoles 12 have a non-symmetrical shape that presents difficulties in providing a suitable support therefore. As previously discussed, the consoles must be mounted in such a way as to be firmly in place while at the same time not subject to abrasion or impacting of the exterior surfaces thereof which are finished surfaces and will be observable when mounted in a vehicle.

Figure 2:
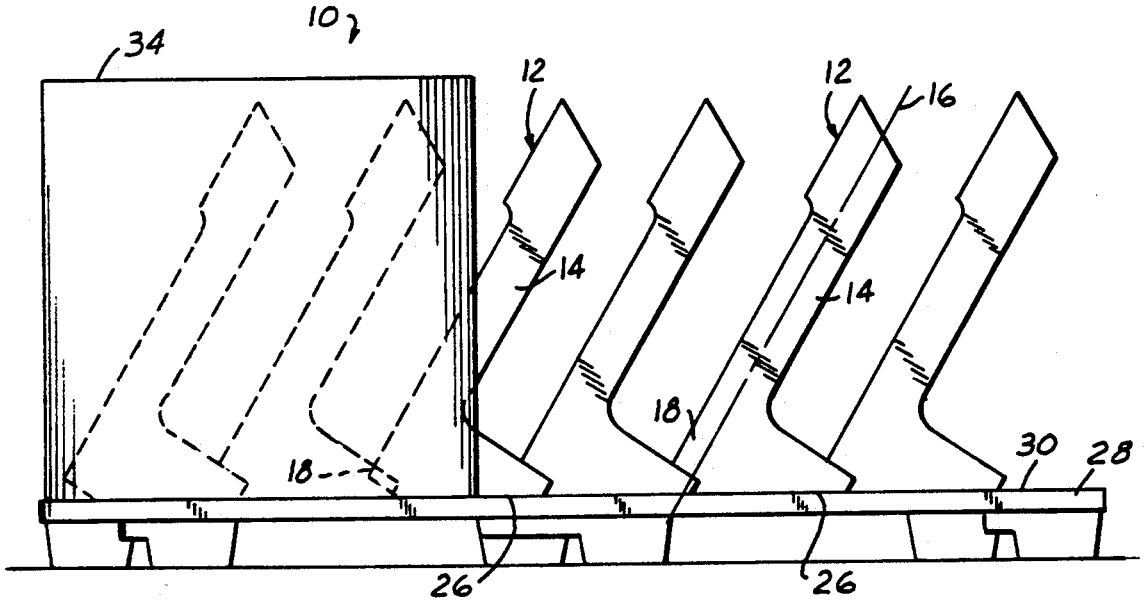
FIG. 2 is a side elevational view of the shipping rack of FIG. 1 with the lid and side walls at one end removed for the purpose of clarity.

The basic shape of the consoles will first be described. The consoles 12 are illustrated in the figures, either in solid lines or in dotted lines. Each console 12 comprises an elongated body 14 having a longitudinal axis 16 as shown in FIG. 2. An enlarged portion 18 is provided at one end of the elongated body 14. The enlarged portion 18 has a recess 20 therein. The recess 20 is partially defined by a pair of spaced apart side walls 22, 24. In use, the console 12 is mounted between the two seats in the front of a vehicle with the elongated body 14 generally horizontally disposed and the enlarged portion 18 generally vertically disposed. Each of the side walls 22, 24 terminates in an outer edge 26 which is at an acute angle with respect to the longitudinal axis 16 of the elongated body 14 as will be noted in FIG. 2.

Figure 3:
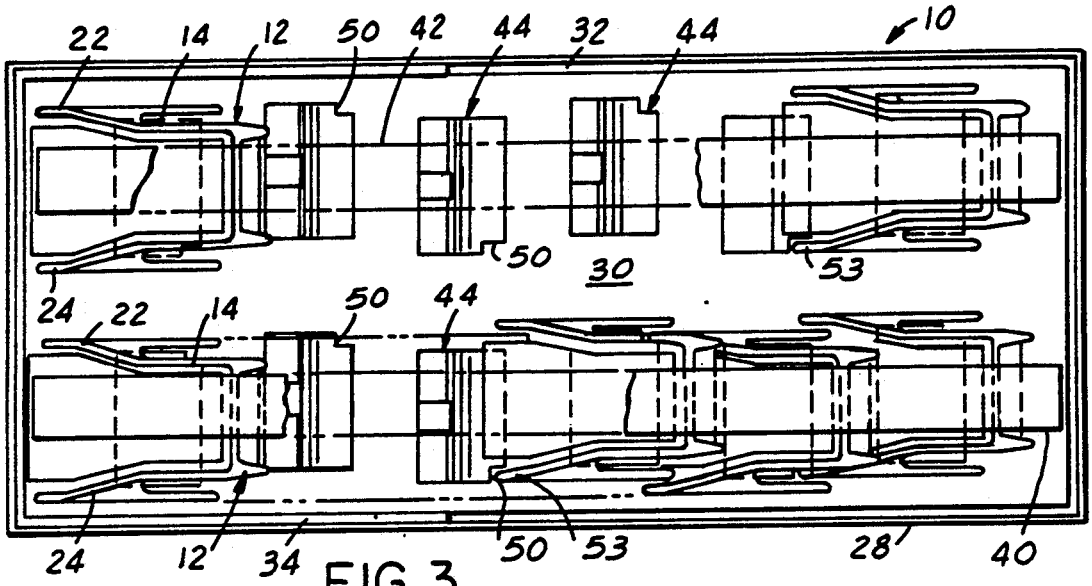
FIG. 3 is a top plan view of the shipping rack as illustrated in FIG. 2.

The shipping rack 10 includes a base 28 having a generally horizontal loading surface 30. A peripheral groove 32 noted in FIG. 3 is provided around the outer edges of the loading surface 30 to receive the lower edge portions of hinged side wall members 34, 36. The side wall members 34, 36 do not meet at the center as will be noted in FIG. 1 as this is not necessary. The side wall members 34, 36 may be erected or removed as needed. A lid 38 is received on the upper edges of the side wall members 34, 36 after the shipping rack 10 is loaded with consoles 12. When the shipping rack is unloaded, these members may be collapsed into a much smaller volume for return to the manufacturing plant from which they originated. As will be noted in FIG. 3, a pair of elongated strips of cardboard 40, 42 are set on the tops of the consoles 30 when the shipping rack 10 is loaded and before the lid 38 is placed thereupon. The cardboard strips 40, 42 protect the upper portions of the consoles from abrasion. It is desired that the lid 38 press firmly against the consoles in order to maintain the consoles in place during transport or storage.

A plurality of spaced apart supports 44 are secured on the loading surface 30. As will be noted in FIG. 5, the loading surface 30 may be defined by a wood panel structure 46 which is secured to a stronger plastic base member 48.

The supports 44 are block-like members having an exterior configuration matching the interior configuration of the recess 20 of the enlarged portion 18 of the vehicle center console assembly 12 as will be noted in the various figures. Each support 44 is adapted to receive a vehicle center console assembly 12 with the outer edges 26 of the side walls 22, 24 resting on the shipping rack loading surface 30 which positions the longitudinal axis 16 of the elongated body 14 at an acute angle with respect to the loading surface 30. This arrangement provides for a firm seating of the consoles 12 on the loading surface 30.

The supports 44 are arranged in at least one row, two rows being illustrated, on the shipping rack loading surface 30. Each support 44 in each row is spaced apart longitudinally on the shipping rack loading surface 30 with respect to adjacent supports 44 in the row and is spaced apart slightly laterally on the shipping rack loading surface 30 with respect to adjacent supports 44 in the row as will be noted in FIGS. 3, 4 and 5. This arrangement results in maximum use of the available space in the shipping rack and also results in a more secure mounting arrangement of the side walls 22, 24 of the consoles 30. As will be noted in FIGS. 4 and 5, each support 44 has a vertical notch 50 in one corner. The notches 50 of adjacent supports 44 are provided in alternating corners to receive alternating corners 52, 53 of the side walls to thereby laterally secure the consoles 30 in place and prevent contact therebetween.

Figure 4:
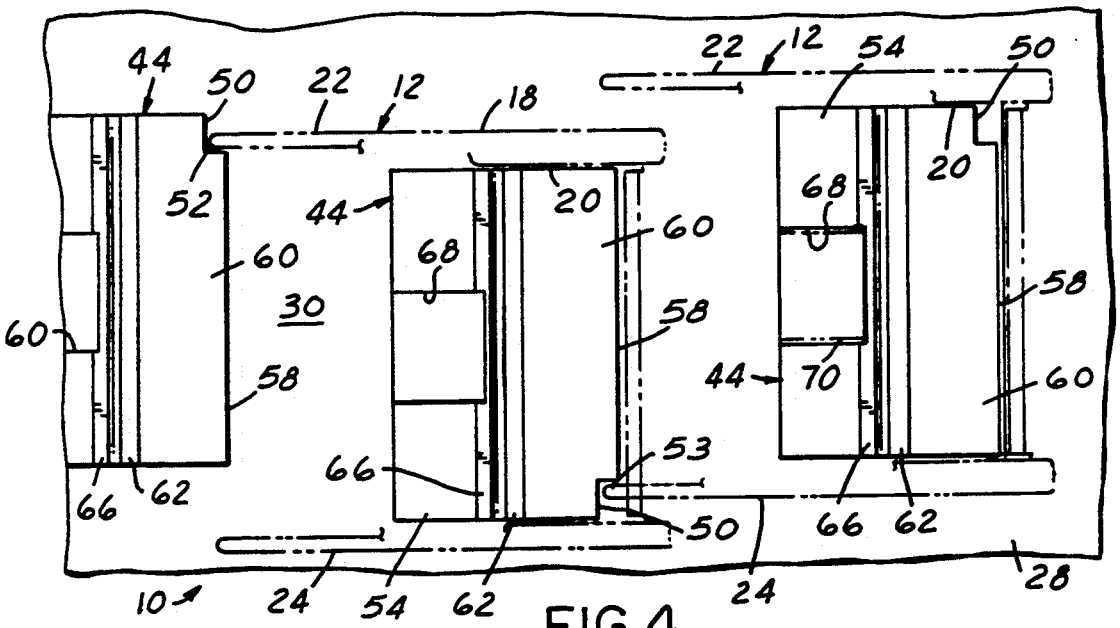
FIG. 4 is a view of a portion of the rack of FIG. 3 on an enlarged scale.
Figure 5:
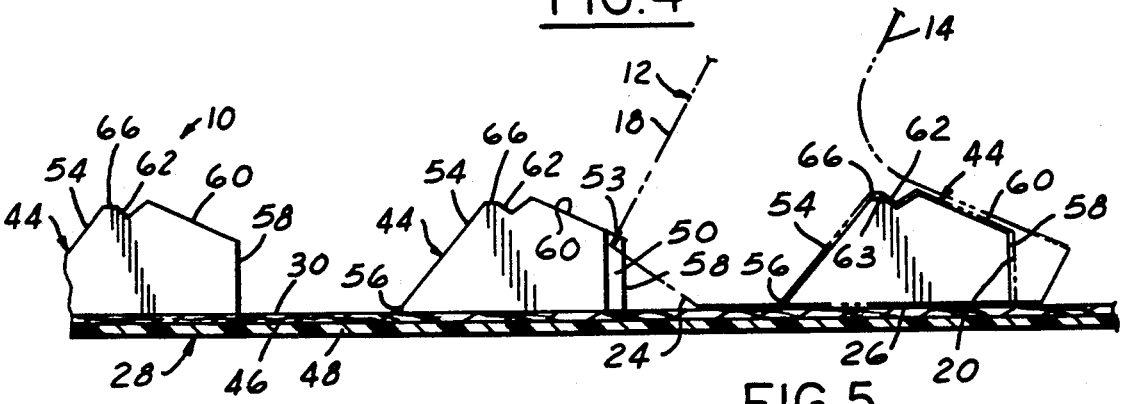
FIG. 5 is a side elevational view of the structure illustrated in FIG. 4.

The exterior configuration of each support 44 is best seen in FIGS. 4 and 5. As will be noted, each support 44 has a forward surface 54 extending upwardly and rearwardly of the support at an acute angle with respect to the loading surface 30. A relatively short, vertical surface 56 connects the lower edge of the forward surface 54 to the loading surface 30. A rearward surface 58 extends upwardly from the loading surface 30 at substantially right angles thereto. An upper surface interconnects the forward and rearward surfaces 54, 58. The upper surface includes a first portion 60 which extends upwardly and forwardly from the rearward surface 58 towards the forward surface 54. A laterally extending second portion 62 comprising a V-shaped notch extends along the forward edge of the first portion 60. The V-shaped notch is adapted to receive a projecting portion 63 which exists within the recess 20 of the enlarged portion 18 of the console. A third substantially horizontal portion 66 interconnects the second portion 62 and forwards surface 54. As will be noted in FIG. 5, the surfaces 54, 56, 58, 60 and 66 interfit with related surfaces within the recess 20. Referring to FIG. 4, it will be noted that a longitudinally extending recess 68 is provided centrally of the forward surface 54 and extends for the width thereof. The recess 68 receives projecting portion 70 which exists within the recess 20.

The structure thus described adequately supports the vehicle center console assemblies 12 and permits shipment and storage thereof without damage to the finished surfaces.

We claim:

1. A shipping rack including a base having a generally horizontal loading surface, a plurality of spaced apart supports secured on the loading surface, each support being for receiving and supporting a vehicle center console assembly which includes an elongated body having a longitudinal axis, an enlarged portion at one end of the elongated body having a recess therein, the recess being partially defined by a pair of spaced apart side walls each of which terminates in an outer edge which is at an acute angle with respect to the longitudinal axis of the elongated body, the supports each being a block-like member having an exterior configuration matching the interior configuration of the recess of the enlarged portion of the vehicle center console assembly to receive a vehicle console assembly thereon with the outer edges of said side walls resting on the shipping rack loading surface and the longitudinal axis of the elongated body at an acute angle with respect to the loading surface, the supports being arranged in at least one row on the shipping rack loading surface, each support being spaced apart longitudinally on the shipping rack loading surface with respect to adjacent supports and being spaced apart slightly laterally on the shipping rack loading surface with respect to adjacent supports, each support having a vertical notch in one corner, the notches of adjacent supports being provided in alternating corners to receive alternating corners of the side walls of a vehicle center console assembly mounted on adjacent supports and laterally secure the vehicle center console in place and prevent contact therebetween.

2. A shipping rack as defined in claim 1, wherein said exterior configuration of each support comprises a forward surface extending upwardly and rearwardly of the support at an acute angle with respect to the loading surface of the shipping rack base, a rearward surface extending upwardly at substantially right angles to the loading surface, and an upper surface interconnecting the forward and rearward surfaces.

3. A shipping rack as defined in claim 2, wherein the upper surface includes a first portion extending upwardly and forwardly from the rearward surface towards the forward surface of the support.

4. A shipping rack as defined in claim 3, wherein the upper surface includes a laterally extending second portion comprising a V-shaped notch extending along the forward edge of said first portion of the upper surface, and a third substantially horizontal portion interconnecting the second portion and the forward surface.

5. A shipping rack as defined in claims 4, wherein a longitudinally extending recess is provided centrally of the forward surface extending for the width thereof.

* * * * *